US010960464B2

(12) United States Patent
Kim

(10) Patent No.: US 10,960,464 B2
(45) Date of Patent: Mar. 30, 2021

(54) METHOD OF CASTING HETEROGENEOUS MATERIALS AND A CASTING PRODUCT MANUFACTURED THEREBY

(71) Applicants: Hyundai Motor Company, Seoul (KR); Kia Motors Corporation, Seoul (KR)

(72) Inventor: Jinkwan Kim, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/687,123

(22) Filed: Nov. 18, 2019

(65) Prior Publication Data

US 2020/0316681 A1 Oct. 8, 2020

(30) Foreign Application Priority Data

Apr. 8, 2019 (KR) ..... 10-2019-0040850

(51) Int. Cl.

| | |
|---|---|
| ***B22D 19/16*** | (2006.01) |
| ***B22C 9/06*** | (2006.01) |
| ***B22C 3/00*** | (2006.01) |

(52) U.S. Cl.

CPC ..... *B22D 19/16* (2013.01); *B22C 3/00* (2013.01); *B22C 9/06* (2013.01)

(58) Field of Classification Search

CPC .. B22D 19/16; B22C 3/00; B22C 9/00; B22C 9/06

See application file for complete search history.

(56) References Cited

U.S. PATENT DOCUMENTS 5,000,244 A * 3/1991 Osborne ..... B22C 9/046 164/34

FOREIGN PATENT DOCUMENTS

| | | | |
|---|---|---|---|
| KR | 100872045 | B1 | 12/2008 |
| KR | 10-1256126 | A | 4/2013 |
| KR | 20130073542 | A | 7/2013 |
| KR | 101736150 | B1 | 5/2017 |
| KR | 10-2017-0122631 | A | 11/2017 |

* cited by examiner

*Primary Examiner* — Kevin P Kerns
*Assistant Examiner* — Steven S Ha
(74) *Attorney, Agent, or Firm* — Mintz Levin Cohn Ferris Glovsky and Popeo, P.C.; Peter F. Corless

(57) ABSTRACT

Disclosed are a method of casting heterogeneous materials and a casting produced manufactured by the same. The method may include disposing a lost foam on a cavity of a mold as the cavity being formed in a shape corresponding to a shape of a casting product; injecting a first molten metal through a low-pressure molten metal ingate formed in the mold to form a low-pressure casting portion of the casting product; and injecting a second molten metal through a gravity molten metal ingate formed in the mold to form a gravity casting portion of the casting product.

5 Claims, 1 Drawing Sheet

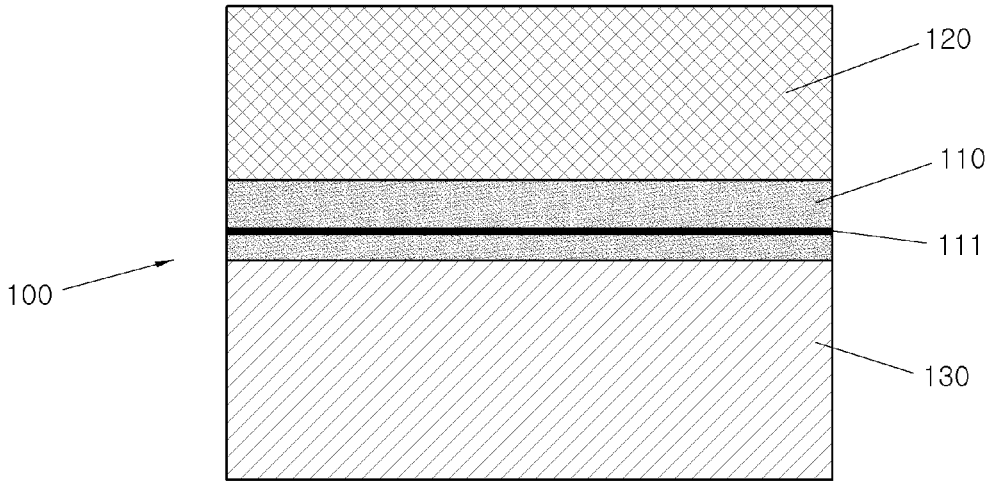
120
110
111
100
130

METHOD OF CASTING HETEROGENEOUS MATERIALS AND A CASTING PRODUCT MANUFACTURED THEREBY

CROSS-REFERENCE(S) TO RELATED APPLICATIONS

This application claims priority to Korean Patent Application No. 10-2019-0040850, filed on Apr. 8, 2019, the disclosure of which is incorporated herein by reference in its entirety.

TECHNICAL FIELD

Exemplary embodiments of the present invention relate to a method of casting heterogeneous materials and a casting product manufactured by the method.

BACKGROUND

Vehicle parts and the like, which are made of heterogeneous materials, have many advantages compared to parts made of a single material because they make it possible to reduce weight of the vehicle parts themselves as well as a finished vehicle and to reduce the cost.

For example, in a cylinder head, a lower section thereof which is subject to high thermal load is made of an aluminum alloy material whereas an upper section thereof which is subjected to heavy abrasion is made of a bakelite polymer material so that its function can be more enhanced while lightening its weight.

In the related art, in order to manufacture a casting product of heterogeneous materials, such as a cylinder head, two pieces of different materials have been manufactured by separate different processes respectively and then by joining the separate parts together. Therefore, process may be disadvantageous and bonding strength of the two pieces of heterogeneous materials may not be sufficient.

The above information disclosed in this Background section is only for assisting understanding of the background of the disclosure and it may therefore contain information that does not form the prior art that is already known to those who have ordinary skill in the art.

SUMMARY

In preferred aspects, provided are a method of casting heterogeneous materials, for example, by casting two pieces simultaneously by means of a composite casting process rather than a separate casting method, and a casting product manufactured by the method.

Other objects and advantages of the present disclosure can be understood by the following description and become apparent with reference to the embodiments of the present disclosure. Also, it is obvious to those skilled in the art to which the present disclosure pertains that the objects and advantages of the present disclosure can be realized by the means as claimed and combinations thereof.

In one aspect, provided is a method of manufacturing a casting product including casting heterogeneous materials. The method may include: disposing a lost foam on a cavity of a mold; injecting a first molten metal into the mold for low-pressure casting to form a low-pressure casting portion of the casting product through a low-pressure molten metal ingate formed in the mold to form a low-pressure casting portion of the casting product; and injecting molten metal into the mold through a gravity molten metal ingate formed in the mold to form a gravity casting portion of the casting product. The cavity may be formed in a shape corresponding to a shape of a casting product.

The term "low-pressure casting" as used herein refers to a casting process of alloy (e.g. aluminum alloy) using a gas at low pressure, for example, between 2 and 20 psi (13 to 140 kPa) to push a molten metal for the alloy into the mold cavity. For example, a pressure may be applied on a surface or top portion of the molten metal so as to force the molten metal into the mold.

The term "gravity casting" as used herein refers to a casting process of alloys using gravity to fill a molten metal of the alloy into a mold. Exemplary process may include heating of the mold and coating it with a releasing agent (e.g., spray), filling he molten metal into the mold by gravity, and cooling for casting.

Further, the first molten metal for the low-pressure casting portion and the second molten metal for the gravity casting portion may be different from each other in material compositions thereof. For instance, the first and second molten metal may be different in the content of certain components as follows: taking a cylinder head as an example, the first molten metal for casting a lower part of the cylinder head may be made of A356 (Cu: 0.2% or less, Mg: 0.2% to 0.4%, Si: 6.5% to 7.5%, Fe: 0.2% or less) and the second molten metal for casting an upper part of the cylinder head may be made of A333 (Cu: 2% to 4%, Mg: 0.5% or less, Si: 7% to 10%, Zn: 1.0% or less, Fe: 1.0% or less). The A356 is a high thermal conductivity and toughness material having hardness of HB 100 and elongation of 6% or more upon T6 heat treatment, while the A333 is a high strength and wear resistance material having hardness of HB 140 and elongation of 1 to 2% upon the same T6 heat treatment. This example is suitable for the cylinder head because the A333 is suitable for the part where a cam shaft rotates and the material constituting combustion chambers are required to have high thermal conductivity and high toughness. Further, this example makes it possible to reduce material costs because the A333 is cheaper than the A356. It is to be understood that this is merely an illustrative example and various heterogeneous materials may be used depending on the use and combination of parts.

Preferably, the point of time when the injected first molten metal for low-pressure casting portion reaches the lost foam may be the same as the point of time when the injected second molten metal for gravity casting injected portion reaches the lost foam.

Preferably, an interface formed by joining of the first molten metal for the low-pressure casting portion and the second molten metal for the gravity casting portion may be formed at a position where the lost foam is disposed.

The method may further include disposing a core in the cavity.

In an aspect, provided is a casting product including a low-pressure casting portion formed by casting a first molten metal for low-pressure casting, a gravity casting portion formed by casting a second molten metal for gravity casting, and a lost foam portion positioned between the low-pressure casting portion and the gravity casting portion and formed by melting of a lost foam.

Preferably, a part of the lost foam portion may be formed by melting of the lost foam, which may be caused by the molten metal for low-pressure casting.

Preferably, the low-pressure casting portion and the gravity casting portion may be different from each other in material compositions thereof.

Preferably, a part of the lost foam portion may be formed by melting of the lost foam, which may be caused by the molten metal for low-pressure casting. Further, a part of the lost foam portion may be formed by melting of the lost foam, which may be caused by the molten metal for low-pressure casting, and the remaining part of the lost foam portion may be formed by melting of the lost foam, which is caused by the molten metal for gravity casting.

Further, since there are means for preventing the core from floating, that is, molten metal injected from above and a portion for casting the lost foam, it is possible to perform the low pressure casting at higher pressure than that in the conventional low pressure casting and it is advantageous in filling the molten metal because of higher pressure and it is possible to improve bubble defects in the molten metal.

Also provided is a vehicle part including the casting product as described herein.

Still provided is a vehicle including the vehicle part as described herein.

Moreover, the present invention can be applied to various technical fields other than vehicles.

Other aspects of the invention are disclosed infra.

BRIEF DESCRIPTION OF THE DRAWINGS

The above and other objects, features and other advantages of the present disclosure will be more clearly understood from the following detailed description taken in conjunction with the accompanying drawings, in which:

FIG. 1 shows an exemplary casting product manufactured by an exemplary casting method according to an exemplary embodiment of the present invention.

DETAILED DESCRIPTION

In order to fully understand the present invention, operational advantages of the present invention and objects achieved by implementing the present invention, the accompanying drawings exemplifying preferred embodiments of the present invention and contents described in the accompanying drawings need to be referred to.

In describing the preferred embodiments of the present invention, detailed description of technology known in the art or iterative description may be made shortly or omitted to avoid obscuring the subject matter of the present invention.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprisentended to include the plural forms as well, unless the context clearly indicates otherwise. It will be further understood that the terms elements and/or components but do not preclude the presence or addition of one or more other features, regions, integers, steps, operations, elements, components, and/or combinations thereof.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

Further, unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

FIG. 1 shows an exemplary casting product manufactured by an exemplary casting method according to an exemplary embodiment of the present invention.

Hereinafter, an exemplary method of casting heterogeneous materials and an exemplary casting product according to various exemplary embodiments of the present invention will be described with reference to FIG. 1.

Provided are, inter alia, a casting method for manufacturing a casting product of heterogeneous materials. Particularly, the product may be manufactured by a single process in a multiple and complex casting manner by applying a plurality of casting techniques rather than a manner of manufacturing two pieces separately and then bonding them together.

In other words, the casting method disclosed herein may be a casting method to which a low-pressure casting technique, a gravity casting technique and a lost foam technique are all applied.

First, a mold having a cavity corresponding to a shape of a product to be cast may be prepared.

The mold may be prepared in such a manner that it may be divided into a movable mold and a stationary mold and then the movable and stationary molds are combined. For example, an upper portion of the mold may be formed with a gravity molten metal ingate penetrating a top surface of the mold from the cavity and a lower portion of the mold may be formed with a low-pressure molten metal ingate penetrating a bottom surface of the mold from the cavity.

The positions of the gravity molten metal ingate and the low-pressure molten metal ingate may be arranged differently depending on casting products to be manufactured.

Next, a lost foam may be placed in the cavity before combining the upper and lower molds.

For example, the lost foam 110 may be formed on a boundary portion between a gravity casting portion 120 formed by gravity casting and a low-pressure casting portion 130 formed by low-pressure casting. Preferably, a portion where an interface 111 may be formed by joining of a second molten metal for gravity casting and a first molten metal for low-pressure casting. The molds may be provided with a means for disposing and fixing the lost foam 110.

The lost foam 110 may prevent the gravity molten metal ("second molten metal") by gravity casting and the low-pressure molten metal ("first molten metal") by low-pressure casting from mixing with each other until it is melted by the molten metals. When the lost foam is melted by the molten metals, the gravity molten metal and the low-pressure molten metal may contact each other in the portion where the lost foam 110 is located.

Thickness of the lost foam 110 may vary depending on casting products and may be determined in consideration of amount of molten metals to be injected, injection rate and melting time.

Further provided is an exemplary casting method in which the lost foam 110 may function as a core and may be inserted into the mold. In addition, since the degree of freedom in designing shape of the lost foam is high, the method may be more advantageous in obtaining a desired shape of the casting product.

Moreover, it is possible to further apply another core in addition to the lost foam. Particularly, for a simple inner shape, it is possible to efficiently manufacture the casting product even using the core. For example, in order to make a complicated shape, using the lost foam may be efficient in manufacturing the casting product.

Further, this lost foam may be advantageous in that unlike the prior art, a foam may be prepared and then the foam may be filled with sand containing binder and solidified to a certain extent and thereafter sand may be removed after casting.

For example, the sand may be required to be solidified to a certain extent such that the foam may be seated in the mold at a temperature range where the foam does not melt.

Next, after the lost foam 110 prepared as described above may be placed in the mold and the two molds may be combined, the first molten metal for low-pressure casting for forming a low-pressure casting portion 130 may be injected through the low-pressure molten metal ingate by a low-pressure casting machine. Preferably, the second molten metal for gravity casting for forming a gravity casting portion 120 of which material may be different from that of the low-pressure casting portion 130 may be injected through the gravity molten metal ingate by a gravity casting machine.

Injection timing of the molten metal for low-pressure casting and the molten metal for gravity casting may be simultaneous and the molten metals may be sequentially injected at a regular interval according to an exemplary design of the casting product. Further, even in the case where the molten metals are sequentially injected, the order of injection of the first molten metal for low-pressure casting and the second molten metal for gravity casting may vary depending on casting products. Preferably, the points of time when the first molten metal for low-pressure casting and the second molten metal for gravity casting reach the lost foam 110 may be the same each other.

The molten metals may be injected and then the lost foam 110 may be melted down as described above so that a joining interface 111 between the gravity casting portion 120 and the low-pressure casting portion 130 may be formed at the portion where the lost foam 110 is disposed. Then, a finished casting product 100 may be taken out by separating the molds after cooling.

In the conventional method, it is necessary to regulate density of each of the molten metals or time for injecting the molten metals in order to form an interface on which molten metals of heterogeneous materials are joined. Further, due to such adjustment, variables in the position of forming the interface between heterogeneous materials may be inevitably large.

According to various exemplary embodiments of the present invention, the lost foam may delay mixing between the molten metals and thus an interface between heterogeneous materials may be limited to the portion where the lost foam is located so that it is advantageous in securing the interface at a stable position in mass production compared to the conventional casting method.

Further, the lost foam may be melted down by the molten metals and in turn the surface configuration of the lost foam before being melted down may be transferred to the molten metals and remained as it was.

In other words, although the casting product is, in practice, made of two pieces of heterogeneous materials, it may have a shape as when it is made of three pieces including the lost foam portion formed by melting down of the lost foam. As such, the lost foam may provide various suitable design configuration of a hollow portion in the casting product.

In an exemplary embodiment of the present invention, gravity casting, low-pressure casting and lost foam techniques may be performed in a multiple and complex manner to carry out casting of heterogeneous materials by a single process so that joining between the heterogeneous materials may be improved and formation of the interface between the heterogeneous materials may be facilitated.

In other words, various exemplary embodiments of the present invention may complement disadvantages of the three casting techniques as mentioned above and take advantages of each of them in casting heterogeneous materials. For example, as the amount of molten metal corresponding to the entire casting may be injected from a lower portion of the mold, an ingate must be large. As such, when parts where quality of microstructure of a lower portion is important, for example, a cylinder head or a cylinder block which is required to have fine microstructure to improve physical properties because load in combustion chambers or a crank bore portion is heavy during operation, there is a limit to application of a lower cooling mode to such parts.

In contrast, according to the various exemplary embodiments of the present invention, the amount of the molten metal injected through a lower downgate may be much less compared to the conventional low-pressure casting technique, an ingate for low-pressure molten metal may be set less than the convention method so that a certain amount of extra free space may be secured. Therefore, as the extra free space may be provided with a cooling means, it is possible to improve physical properties of a casting product by improving quality of microstructure thereof compared to the conventional low-pressure casting technique.

Further, vortex may occur in the process of injecting the molten metal in the conventional gravity casting, whereas the embodiment of the present invention may improve occurrence of such vortex.

Moreover, in the case of manufacturing a casting by low-pressure casting or gravity casting, a core is used to form shapes of a complex water jacket and an oil jacket. In this case, an undercut is generated in a core mold when making the core and it is impossible to make a thin shape that is difficult to form with core sand.

In contrast, according to the various exemplary embodiments of the present invention, the casting method may include using a lost foam which allows for freely making any shape at an intermediate portion of the casting. Therefore, it is advantageous in that any shape may be designed freely by virtue of the advantages of the lost foam.

In addition, the conventional lost foam casting is a process in which molten metal is injected in a state where a foam is buried in sand (sand casting). Therefore, it is difficult to improve quality of microstructure of the casting because cooling rate of the casting is slow. In addition, there is a disadvantage that gas generated by burning of the foam damages integrity of the casting.

In contrast, according to the embodiment of the present invention, the casting method may provide that both the gravity casting and the low-pressure casting may be basically used and thus, overall quality of microstructure may be greater than that of the conventional sand casting. In addition, only the middle portion of the casting may be formed by the foam and thus, less gas may be generated by burning of the foam.

Therefore, unlike the sand lost foam casting, the various exemplary embodiments of the present invention may provide the casting method to draw out the gas being generated through a vent formed in the mold. In addition, since the area of an upper riser in the various exemplary embodiments of the present invention is greater than that in the conventional lost foam casting technique, a good casting with low porosity in comparison with the conventional technique may be obtained.

As described above, in the various exemplary embodiments of the present invention, a casting product of heterogeneous materials may be manufactured by a single process in a multiple manner rather than a manner of joining several pieces manufactured by performing several casting techniques separately. Nevertheless, the exemplary casting method may manufacture the casting product with improved quality of joining portions and microstructure.

Further, according to the various exemplary embodiments of the present invention, gravity casting and lost foam techniques in a multiple and complex manner may be used rather than a manner of manufacturing pieces of heterogeneous materials separately thereby providing efficient process and reducing time and cost.

Nevertheless, casting may be performed without mixing of the first molten metal by the low-pressure casting and the second molten metal by the gravity casting, which are different from the former molten metal with the lost foam.

Further, since it is not necessary to regulate density, injection time, or the like of molten metals of heterogeneous materials in order to form an interface at which the molten metals contact each other, variables in the position of forming the interface between the heterogeneous materials are increased. In addition, by the foam which serves to delay mixing between the molten metals, the interface between the heterogeneous materials may be limited to the portion where the foam was located. Consequently, the interface at a stable position may be secured in mass production compared to the conventional casting method.

Although the present invention has been described in the foregoing with reference to the drawings illustrated by way of example, the present invention is not limited to the disclosed embodiments, and it will be apparent to those of ordinary skill in the art that various modifications and variations can be made to the present invention without departing from the spirit and scope of the disclosure. Therefore, such modifications or variations fall within the scope of the present invention as claimed and the scope of the present invention should be interpreted based on the appended claims.

What is claimed is:

1. A method of manufacturing a casting product comprising heterogeneous materials, comprising:

disposing a lost foam on a cavity of a mold, the cavity being formed in a shape corresponding to a shape of a casting product;

injecting a first molten metal into the mold through a low-pressure molten metal ingate formed in the mold to form a low-pressure casting portion of the casting product; and injecting a second molten metal into the mold through a gravity molten metal ingate formed in the mold to form a gravity casting portion of the casting product.

2. The method according to claim 1, wherein the first molten metal for the low-pressure casting portion and the second molten metal for gravity casting portion are different from each other in their material compositions thereof.

3. The method according to claim 1, wherein a point of time when the injected first molten metal for the low-pressure casting portion reaches the lost foam is same as a point of time when the injected second molten metal for the gravity casting portion reaches the lost foam.

4. The method according to claim 1, wherein an interface formed by joining of the first molten metal for the low-pressure casting portion and the second molten metal for the gravity casting portion is formed at a position where the lost foam is disposed.

5. The method according to claim 1, further comprising disposing a core in the cavity.

* * * * *